US006096824A

United States Patent [19]

Phan et al.

[11] Patent Number: 6,096,824

[45] **Date of Patent: *Aug. 1, 2000**

[54] AQUEOUS EMULSION POLYMER CONTAINING A POLYMERIZABLE ALLYL AMINE SALT, AND PAPER SATURANT THEREOF

[75] Inventors: Lien Phan, Mississauga; Rajeev Farwaha, Brampton, both of Canada; Steven P. Pauls, Sr., Old Bridge, N.J.; Alan J. Blackie, Guelph, Canada

[73] Assignee: National Starch and Chemical Investment Holding Corporation, Wilmington, Del.

[ * ] Notice: This patent is subject to a terminal disclaimer.

[21] Appl. No.: 09/037,306

[22] Filed: Mar. 9, 1998

[51] Int. Cl.[7] ..... C08L 55/00; C08F 12/30

[52] U.S. Cl. ..... 524/817; 526/89; 526/287

[58] Field of Search ..... 524/457, 817; 526/287, 89

[56] References Cited

U.S. PATENT DOCUMENTS

| | | | |
|---|---|---|---|
| 3,218,225 | 11/1965 | Petropoulos | 161/248 |
| 3,220,916 | 11/1965 | Petropoulous | 161/151 |
| 3,589,974 | 6/1971 | Albrinck et al. | 161/150 |
| 3,938,907 | 2/1976 | Magoveny et al. | 415/141 |
| 3,975,572 | 8/1976 | Power | 428/452 |
| 4,473,613 | 9/1984 | Jaisle et al. | 428/220 |
| 4,659,595 | 4/1987 | Walker et al. | 427/391 |
| 5,859,111 | 1/1999 | Kukkala et al. | 524/458 |
| 5,928,783 | 7/1999 | Phan et al. | 428/355 EN |
| 5,945,473 | 8/1999 | Kielbania et al. | 524/457 |

*Primary Examiner*—David W. Wu
*Assistant Examiner*—Kelechi Egwim
*Attorney, Agent, or Firm*—Ellen T. Dec

[57] ABSTRACT

A paper saturant composition comprising an aqueous emulsion polymer prepared by reacting at least one ethylenically unsaturated monomer and from about 0.1 to about 5 weight percent, based on the total weight of ethylenically unsaturated monomer, of a water-soluble or water-dispersible polymerizable surfactant having a terminal allyl amine moiety. Paper saturated with the emulsion is especially useful in the production of core sheets used to prepare decorative laminates.

11 Claims, No Drawings

AQUEOUS EMULSION POLYMER CONTAINING A POLYMERIZABLE ALLYL AMINE SALT, AND PAPER SATURANT THEREOF

FIELD OF THE INVENTION

The invention relates to paper saturated with an aqueous emulsion polymer which is useful in a decorative laminate. The polymer is prepared by reacting an ethylenically unsaturated monomer with a water-soluble or water-dispersible polymerizable surfactant having a terminal allyl amine moiety.

BACKGROUND OF THE INVENTION

Decorative laminates are widely employed in the building industry as counter and table tops, bathroom and kitchen work surfaces, furniture and cabinets, wall paneling, partitions, doors, wallpaper, book covers, map and label stock. High-pressure decorative laminates are laminated articles comprising plural layers of synthetic resin impregnated paper sheets consolidated or bonded together into a unitary structure under heat and pressure. Conventionally, the decorative or print layer is a sheet of high quality purified alpha cellulose fiber and/or certain rayon fibers impregnated with a thermosetting condensation resin such as aminotriazine aldehyde resins, for example melamine formaldehyde resins. An overlay sheet, transparent when cured, may be employed to protect the decorative or print layer and is also a sheet of alpha cellulose, or the like, impregnated with an aminotriazine aldehyde. The overlay and print sheets are bonded to a plurality of core or body sheets of fibrous cellulosic material, usually kraft paper, most generally impregnated with a thermosetting phenol-formaldehyde resin.

The major portion of the paper in a decorative laminate is composed of the core or body sheets rather than the print or overlay sheets. Typically seven or eight core sheets are consolidated with only a single print and single overlay sheet to form a conventional 1/16 inch decorative laminate.

Although the core sheets are less expensive than the print or overlay sheets, it is apparent that the core sheets are a significant cost factor, because of their volume in a decorative laminate. Typically from three to nine core sheets of 30 to 130 pound/per ream (3000 $ft^2$) paper are used in the preparation of decorative laminates. It is also apparent that the properties of the core stock paper which depending on the resins employed will influence the properties of the end product decorative laminate.

U.S. Pat. Nos. 3,220,916, 3,218,225, and 3,589,974 describe phenol-formaldehyde resins which are used to impregnate kraft core sheets in the production of high pressure decorative laminates. U.S. Pat. Nos. 3,938,907 and 3,975,572 describe the use of a mixture of melamine-formaldehyde and acrylic resins, and U.S. Pat. No. 4,473,613 describes a mixture of a thermoset blend of a phenol-formaldehyde resin, a cross-linked acrylic resin and a melamine-formaldehyde resin which are used to impregnate core sheets in the production of decorative laminates.

U.S. Pat. No. 4,659,595 describes saturated paper products, particularly masking tape, which are prepared by saturating cellulose fibers with an aqueous emulsion. The aqueous emulsion is prepared by the emulsion polymerization of (a) a vinyl ester of an alkanoic acid, (b) ethylene, (c) an N-methylol containing copolymerizable monomer, (d) an alkenoic acid or an alkenedioc acid, and (e) a surfactant.

Conventional anionic surfactants and nonionic surfactants are typically used to control the latex particle size and to stabilize the latexes at high solid content. Such conventional surfactants are physically absorbed onto the surface of the particles, in dynamic equilibrium with the water phase. However, the surfactants are not covalently bound to the polymer particles. Under high shear or under a few cycles of freeze-thaw tests, the surfactants can be desorbed and their stabilizing properties are lost. Using greater amounts of conventional surfactants may improve stability but high levels of such surfactants introduce significant quantities of ionic species into the polymer, often adversely affecting film properties, particularly water sensitivity due to the hydrophilicity imparted by the surfactant and the tendency of the unbound surfactant to dissolve in water throughout the film.

SUMMARY OF THE INVENTION

Accordingly, it is an object of the present invention to provide a polymer which is useful as a paper saturant.

It is also an object of the invention to provide a polymer which is environmentally safe and cost effective to be applied to core sheets in the production of a decorative laminate.

It is a further object of the invention to provide a stable aqueous emulsion polymer which when formulated into a saturant provides water-resistance to paper.

With regard to the foregoing and other objects, the present invention provides a paper saturant composition which comprises an aqueous emulsion polymer, said polymer comprising the reaction product of at least one ethylenically unsaturated monomer and from about 0.1 to about 5 weight percent, based on the total weight of ethylenically unsaturated monomer, of a water-soluble or water-dispersible polymerizable surfactant having a terminal allyl amine moiety, wherein the polymerization is conducted at a pH of from about 2 to about 7.

In a preferred embodiment, the polymerizable surfactant is an allyl amine salt of alkyl benzene sulfonate having the structure

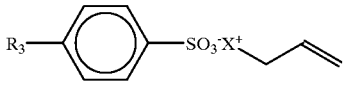

wherein $R_3$ is an alkyl group having 1 to 20 carbon atoms, and X+ is selected from the group consisting of $NH_3^+$, $NH_2R_6$ and $NR_6R_7$ wherein $R_6$ and $R_7$ are independently $C_1$–$C_4$ alkyl or hydroxyalkyl groups.

In a preferred embodiment, the polymerizable surfactant is an allyl amine salt of alkyl ether sulfate having the structure

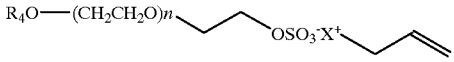

wherein $R_4$ is an alkyl group having 1 to 20 carbon atoms; n is an integer from 2 to 15; and $X^+$ is defined as above.

In a preferred embodiment, the polymerizable surfactant is an allyl amine salt of a phosphate ester having the structure

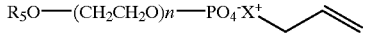

wherein $R_5$ is an alkyl group having 1 to 20 carbon atoms, and n and $X^+$ are defined as above.

According to another aspect the invention provides a method for making paper which comprises: (I) applying to a cellulosic fibrous web a saturant composition comprising an aqueous emulsion polymer which comprises the reaction product of at least one ethylenically unsaturated monomer and from about 0.1 to about 5 weight percent, based on the total weight of ethylenically unsaturated monomer, of a water-soluble or water-dispersible polymerizable surfactant having a terminal allyl amine moiety, wherein said web fibers are impregnated with said saturant and the polymerization is conducted at a pH of about 2 to about 7; and (II) subjecting said impregnated web to a temperature of at least 50° C. for a time sufficient to substantially cure the saturant in the web.

Paper saturated with the aqueous emulsion polymer of the invention is characterized by an excellent balance of toughness, water-resistance, wet strength, fold, edge tear, and delamination resistance, and is especially useful in the production of core sheets used to prepare decorative laminates.

DESCRIPTION OF THE INVENTION

The decorative laminate compositions of the present invention are prepared from an aqueous emulsion polymer. The polymer is prepared from the reaction product of at least one ethylenically unsaturated monomer and a polymerizable surfactant having a terminal allyl amine moiety.

The ethylenically unsaturated monomer is selected from anhydrides, vinyl esters, alpha-olefins, alkyl esters of acrylic and methacrylic acid, substituted or unsubstituted mono and dialkyl esters of unsaturated dicarboxylic acids, vinyl aromatics, unsubstituted or substituted acrylamides, cyclic monomers, monomers containing alkoxylated side chains, sulfonated monomers, and vinyl amide monomers. As used herein, "ethylenically unsaturated monomer" does not include ionic monomers. A combination of ethylenically unsaturated monomers may also be used.

Suitable anhydride monomers are, for example, maleic anhydride and itaconic anhydride. Suitable vinyl esters are, for example, vinyl acetate, vinyl formate, vinyl propionate, vinyl butyrate, vinyl isobutyrate, vinyl valerate, vinyl 2-ethyl-hexanoate, vinyl isooctanoate, vinyl nonanoate, vinyl decanoate, vinyl pivalate, and vinyl versatate. Suitable alkyl esters of acrylic and methacrylic acid are, for example, methyl acrylate, methyl methacrylate, ethyl acrylate, ethyl methacrylate, propyl acrylate, butyl acrylate, pentyl acrylate, hexyl acrylate, and 2-ethyl hexyl acrylate, etc. Suitable substituted or unsubstituted mono and dialkyl esters of unsaturated dicarboxylic acids are, for example, substituted and unsubstituted mono and dibutyl, mono and diethyl maleate esters as well as the corresponding fumarates. Suitable vinyl aromatic monomers preferably contain from 8 to 20 carbon atoms, most preferably from 8 to 14 carbon atoms. Examples of vinyl aromatic monomers are styrene, 1-vinyl napthalene, 2-vinyl napthalene, 3-methyl styrene, 4-propyl styrene, t-butyl styrene, 4-cyclohexyl styrene, 4-dodecyl styrene, 2-ethyl-4-benzyl styrene, 4-(phenylbutyl) styrene, 3-isopropenyl-α, α-dimethylbenzyl isocyanate, and halogenated styrenes.

Suitable acrylamide based monomers are, for example, acrylamide, N, N-dimethylacrylamide, N-octyl acrylamide, N-methylol acrylamide, dimethylaminoethylacrylate, etc. Suitable cyclic monomers are, for example, vinyl pyrrolidone, vinyl imidazolidone, vinyl pyridine, etc. Suitable sulfonated monomers are, for example, 2-acrylamido-2-methyl propane sulfonic acid, sodium methallyl sufonate, sodium vinyl sulfonate, sulfonated sytrene, etc. Suitable vinyl amide monomers are, for example, N-vinyl formamide, N-vinyl acetamide, etc.

In a preferred embodiment of the invention, the ethylenically unsaturated monomer is an alkyl acrylate monomer having the formula:

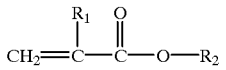

In the above formula $R_1$ is hydrogen or methyl and $R_2$ is an alkyl group having from 1 to 10 carbon atoms. The alkyl groups in the alkyl acrylate monomers can be straight chained or branched. The ethylenically unsaturated monomer is preferably selected from methyl methacrylate, butyl acrylate, styrene and combinations thereof.

Optionally, an ionic monomer may be used in addition to the ethylenically unsaturated monomer. Suitable ionic monomers include, for example, α,β-ethylenically unsaturated $C_3$–$C_8$ monocarboxylic acids, α,β-ethylenically unsaturated $C_4$–$C_8$ dicarboxylic acids, including the anhydrides thereof, and the $C_4$–$C_8$ alkyl half esters of the α,β-ethylenically unsaturated $C_4$–$C_8$ dicarboxylic acids. Preferred ionic monomers are acrylamido methyl propane, sulfonic acid, styrene sulfonate, sodium vinyl sulfonate, acrylic acid, methacrylic acid, and the $C_4$–$C_8$ alkyl half esters of maleic acid, maleic anhydride, fumaric acid, and itaconic acid. Most preferably, the ionic monomer is acrylic acid or methacrylic acid. The ionic monomer may be present in an amount of from about 0.01 to about 10 weight percent, preferably from about 0.1 to about 5 weight percent, based on the amount of ethylenically unsaturated monomer. Most preferably, the ionic monomer is present in an amount of from about 0.5 to about 3 weight percent, based on the total weight of ethylenically unsaturated monomer. A combination of ionic monomers may also be used.

The surfactant is a water-soluble or water-dispersible polymerizable surfactant having a hydrophilic and hydrophobic portion. The hydrophilic portion is selected from a sulfonate allyl amine moiety, a sulfate allyl amine moiety, and a phosphate allyl amine moiety. The hydrophobic portion is selected from either an alkyl group having 1 to 20 carbon atoms, preferably 10 to 18 carbon atoms, or a group having the structure RO—$(CH_2CH_2O)$n—, wherein R is an alkyl group having 1 to 20 carbon atoms, preferably 10 to 18 carbon atoms, and n is an integer from 2 to 15. The hydrophilic portion and the hydrophobic portion are connected by means of a covalent bond. Combinations of such surfactants may also be used in preparing the polymer of the invention.

A preferred polymerizable surfactant having a terminal allyl amine moiety is an allyl amine salt of alkyl benzene sulfonate denoted Structure I:

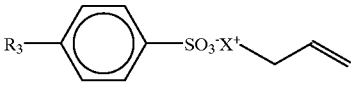

In Structure I, $R_3$ is an alkyl group having 1 to 20 carbon atoms, preferably 10 to 18 carbon atoms; and X+ is selected from $NH_3^+$, $NH_2R_6$ or $NR_6R_7$ wherein $R_6$ and $R_7$ are independently $C_1$–$C_4$ alkyl or hydroxyalkyl groups. Most preferably, the allyl amine salt of alkyl benzene sulfonate is allyl amine salt of dodecylbenzene sulfonate.

Another preferred polymerizable surfactant having a terminal allyl amine moiety is an allyl amine salt of alkyl ether sulfate denoted Structure II:

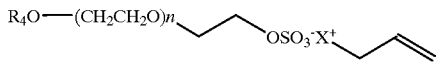

In Structure II, $R_4$ is an alkyl group having 1 to 20 carbon atoms, preferably 10 to 18 carbon atoms; n is an integer from 2 to 15, and $X^+$ is selected from $NH_3^+$, $NH_2R_6$ or $NR_6R_7$ wherein $R_6$ and $R_7$ are independently $C_1$–$C_4$ alkyl or hydroxyalkyl groups. Most preferably, the allyl amine salt of alkyl ether sulfate is allyl amine salt of laureth sulfate.

Another preferred polymerizable surfactant having a terminal allyl amine moiety is an allyl amine salt of a phosphate ester denoted Structure III:

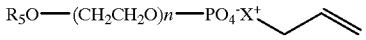

In Structure III, $R_5$ is an alkyl group having 1 to 20 carbon atoms, preferably 10 to 18 carbon atoms; n is an integer from 2 to 15, and $X^+$ is selected from $NH_3^+$, $NH_2R_6$ or $NR_6R_7$ wherein $R_6$ and $R_7$ are independently $C_1$–$C_4$ alkyl or hydroxyalkyl groups. Most preferably, the allyl amine salt of a phosphate ester is allyl amine salt of nonyl phenol ethoxylate (9 moles EO) phosphate ester. Preferred polymerizable surfactants having terminal amine moieties are available under the trademarks POLYSTEP AU1, POLYSTEP AU7 and POLYSTEP AU9 from Stepan Company.

The polymerizable surfactant is present in the aqueous emulsion in an amount of from about 0.1 to about 5 weight percent based on the total weight of ethylenically unsaturated monomer. Preferably, the polymerizable surfactant is present in an amount of from about 0.5 to about 3 weight percent based on the total weight of ethylenically unsaturated monomer in the aqueous emulsion.

The aqueous emulsion may also include one or more surfactants or emulsifiers which are not polymerizable such as anionic and/or nonionic surfactants. Anionic surfactants include, for example, from $C_8$ to $C_{12}$ alkylbenzenesulfonates, from $C_{12}$ to $C_{16}$ alkanesulfonates, from $C_{12}$ to $C_{16}$ alkylsulfates, from $C_{12}$ to $C_{16}$ alkylsulfosuccinates or from $C_{12}$ to $C_{16}$ sulfated ethoxylated alkanols. Nonionic surfactants include, for example, from $C_6$ to $C_{12}$ alkylphenol ethoxylates, from $C_{12}$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. Another modification consists of reacting the free OH groups of the polyalkylene oxides with isocyanates. The nonionic surfactants also include $C_4$ to $C_{18}$ alkyl glucosides as well as the alkoxylated products obtainable therefrom by alkoxylation, particularly those obtainable by reaction of alkyl glucosides with ethylene oxide.

The aqueous emulsion polymer is prepared using free radical emulsion polymerization techniques. The aqueous emulsion polymer may be prepared by emulsion polymerization methods which are known in the art and include batch or continuous monomer addition or incremental monomer addition processes. As used herein, "batch" refers to a process whereby the entire amount of monomer is added in a single charge. As used herein, "continuous monomer addition" and "incremental monomer addition" refer to a process wherein optionally a minor portion of the monomer(s) is initially charged in the reactor and the remainder of the monomer(s) is then added gradually over the course of the reaction. The entire amount of the aqueous medium with polymerization additives can be present in the polymerization vessels before introduction of the monomer(s), or alternatively a portion of it can be added continuously or incrementally during the course of the polymerization.

Essentially any type of free radical generator can be used to initiate the free radical emulsion polymerization. For example, free radical generating chemical compounds, ultraviolet light or radiation can be used. The choice of free radical generating chemical compound depends on the desired polymerization rate and final polymer properties.

Some representative examples of free radical initiators which are commonly used include the various persulfates, percarbonates, perborates, peroxides, azo compounds, and alkyl perketals. Examples of free radical initiators are potassium persulfate, ammonium persulfate, sodium persulfate, benzoyl peroxide, hydrogen peroxide, di-t-butyl peroxide, dicumyl peroxide, caproyl peroxide, 2,4-dichlorobenzoyl perooxide, decanoyl peroxide, lauryl peroxide, cumene hydroperoxide, p-menthane hydroperoxide, t-butyl hydroperoxide, acetyl acetone peroxide, dicetyl peroxydicarbonate, t-butyl peroxyacetate, t-butyl peroxymaleic acid, t-butyl peroxybenzoate, acetyl cyclohexyl sulfonyl peroxide, 2-t-butylazo-2-cyanopropane, dimethyl azodiisobutyrate, azodiisobutyronitrile, 2-t-butylazo-1-cyanocyclohexane, 1-t-amylazo-1-cyanocyclohexane, 2,2'azobis(N,N'dimethyleneisobutyramidine) dihydrochloride, 2,2'azobis(2-amidinopropane) dihydrochloride, 2,2'-azobis(N,N'-dimethyleneisobutyramidine), 4,4'-azobis(4-cyanopentanoic acid), 2,2'-azobis{2-methyl-N-[1,1-bis(hydroxymethyl)-2hydroxyethyl] propionamide}, 2,2'-azobis[2-methyl-N-(2-hydroxyethyl) propionamide], 2,2'-azobis(isobutyramide) dihydrate, 2,2-bis-(t-butylperoxy)butane, ethyl 3,3-bis(t-butylperoxy)butyrate, and 1,1-di-(t-butylperoxy) cycloyhexane. Any combination of free radical initiators may be used to prepare the polymers of the invention.

The amount of free radical initiator employed will vary with the desired molecular weight of the polymer being synthesized. Higher molecular weights are achieved by utilizing smaller quantities of the initiator and lower molecular weights are attained by employing larger quantities of the initiator. However, as a general rule from about 0.005 to about 10 weight percent, preferably from about 0.1 to about 3 weight percent, based on total weight of ethylenically unsaturated monomer, of a free radical initiator will be included in the reaction mixture.

The polymerization is preferably conducted at a temperature which is within the range of about 30° C. to about 95° C. More preferably, the polymerization is conducted at a temperature which is with the range of about 60° C. to about 85° C.

The polymerization is carried out at a pH of about 2 to about 7, preferably at a pH of about 3 to about 6. More preferably, the polymerization is conducted at a pH of from about 3.5 to about 5.5. The pH range is important in order to incorporate, by means of covalent bonding, the polymerizable surfactant onto the polymer particles during polymerization which prevents desorption of the polymerizable surfactant when shear is applied to the latex and produces a more stable latex. In order to maintain the pH range, it may be useful to work in the presence of customary buffer systems, for example, in the presence of alkali metal carbonates, alkali metal acetates, and alkali metal phosphates.

Although the solids content and viscosity of the emulsion can vary typical total solids content which is defined as the nonvolatile components of the emulsion is in the range of from about 1 to about 60 weight percent, preferably 40 to 55 weight percent, based on the total weight of the emulsion.

The emulsion polymerization is generally continued until the residual ethylenically unsaturated monomer content is below about 1%. The latex product is then allowed to cool to about room temperature, while sealed from the atmosphere. A redox scavenger may be added to the polymerization reactor prior to removing the latex in order to react any residual monomer.

The latex of the invention may be formulated with such additives as are commonly incorporated into paper products in order to formulate the paper saturant of the invention. Such additives include formaldehyde resins such as resorcinol formaldehyde, urea formaldehyde, melamine formaldehyde, and phenol formaldehyde. Additionally, phenolic resins, such as trimethylol phenol oligomer which is prepared by any conventional phenolaldehyde condensation reaction, may be added. Such additives also include flame retardants, fillers, pigments, dyes, softeners, post-added surfactants and catalysts, and crosslinking agents. A combination of additives may also be used.

The paper saturant is applied to a web containing cellulose fibers. A wide variety of sources of fibers maybe used such as flax, bagasse, esparto, straw, papyrus, bamboo, jute, softwoods, hardwoods, and synthetic fibers. Examples of softwoods include spruce, hemlock, fir and pine. Examples of hardwoods include popular, aspen, birch, maple and oak.

Any method of applying the paper saturant to the web is acceptable provided the web is impregnated with the saturant. As used herein "impregnate" refers to the penetration of the saturant into the fiber matrix of the web, and to the distribution of the saturant in a preferably substantially uniform manner into and through the interstices in the web. The saturant preferably envelopes, surrounds, and/or impregnates individual fibers substantially through the thickness of the web as opposed to only forming a surface coating on the web.

The saturant is advantageously applied to the cellulosic fibrous web in a papermaking process at the size press section which is typically located between the first and second dryer units.

The treated web is cured at the normal temperatures provided by a drying unit on a papermaking machine, preferably a steam heated drying cylinder. Drying temperatures generally range from about 50° C. to about 120° C. The residence time of the web or paper in the dryer unit ranges from about 5 seconds to about 200 seconds, depending on the temperature. Generally, a residence time of about at least 30 seconds is required for lower temperatures of about 50° C. while less than about 10 seconds is required for higher temperatures of about 120° C. Preferably, the time and temperature required to cure the saturant in the web ranges from about 5 to about 30 seconds at a web temperature ranging from about 80° C. to about 120° C. After the web with the saturant applied thereto is dried/cured, subsequent coatings or additives may be applied.

Optionally, a catalyst may be added to the saturant to promote reaction between the saturant and the cellulose fibers in the web, but it is a feature of the invention that no catalyst is generally required. Suitable catalysts include salts of polyvalent cations such as aluminum chloride and aluminum sulfate. A combination of catalysts may also be used.

Preferred means of applying the saturant on a paper machine are by puddle press, size press, blade coater, speedsizer, spray applicator, curtain coater and water box. Preferred size press configurations include a flooded nip size press and a metering blade size press.

Preferred means of applying the saturant on off-machine coating equipment are by rod, gravure roll and air-knife. The saturant may also be sprayed directly onto the sheet or onto rollers which transfer the saturant to the paper. In one embodiment of the invention, impregnation of the web or sheet with the saturant occurs at the nip point between two rollers. In another embodiment of the invention, the saturation of the web or sheet occurs by passing roll stock of unsaturated base paper through a saturated bath and then through squeeze rolls.

The concentration of saturant in the paper is from about 1 to about 50 weight percent after final drying of the paper. Preferably, the concentration of saturant in the paper is from about 10 to about 30 weight percent after final drying of the paper.

Paper prepared with the saturant of the present invention may be coated. Suitable coatings include matte coatings, cast coatings, and starch coatings. Such coatings and their method of application are well known in the art.

Treatment of paper and cellulose fibrous webs according to the invention enhances the water-resistance of paper, and is especially advantageous for paper used in decorative laminates.

The following test procedures were used to evaluate the saturant compositions of the present invention. The aqueous emulsion polymers were prepared in the form of a latex which was formulated with about 50 weight percent, based on the total weight of the latex, of a combination of melamine formaldehyde and urea formaldehyde resins in order to form a paper saturant.

(1) Water Resistance Test (Cobb Test T441 om-90)

The saturant was applied to a sample of paper and the paper was dried at a temperature of 100° C. by means of a steam dryer can. The amount of saturant in the paper was 25% add on, based on the total weight of the paper sample. The dried paper samples were placed in a forced air oven at a temperature of 135° C. for either 1 or 10 minutes. Each paper sample is cut to a size slightly larger than the outside dimensions of the 11.28 cm ring of the apparatus, i.e., squares 12.5×12.5 cm. The initial weight of the dried paper sample containing saturant is recorded in grams. The paper samples are placed a rubber mat which is attached to a metal plate. A metal ring is placed on the paper sample and secured by means of a crossbar in order to prevent leakage between the ring and the paper sample. Deionized water, 100 ml, is poured into the ring as rapidly as possible and held for 105 seconds. The water is poured quickly from the ring and the paper sample is unclamped and placed onto a piece of 20×20 cm blotting paper. A second sheet of blotting paper is immediately placed on top of the paper sample. A 20 lb. roller weight is immediately rolled over the papers, in two passes, to remove surface water. The paper sample is immediately weighed. The initial weight of the dried paper sample containing the saturant is subtracted from the weight of the wetted paper sample following blotting. The difference in weights is recorded in grams and multiplied by 100 to obtain the weight of water absorbed in grams per square meter.

(2) Mechanical Stability Test

A 100 gram sample of the saturant was placed into a glass cook-up beaker, and placed under a Hamilton Beech mixer which was attached to a rheostate. The saturant sample was agitated at 6500 rpm for 15 minutes. The saturant sample was poured through a clean, pre-weighed 200 wire mesh screen, and rinsed with deionized water to eliminate foam.

The screen was placed in a 100° C. oven until completely dry, and weighed. The difference between the final weight and the initial weight of the screen was calculated as % grit.

The following nonlimiting examples illustrate further aspects of the invention.

EXAMPLE 1

Preparation of Comparative Latex C1

A latex was polymerized using an anionic surfactant Polystep B-27. The formula and procedure were as follows:

| Ingredients | Grams | Concentration in pphm |
|---|---|---|
| Initial Charge | | |
| Water | 265 | 54.9 |
| Monomer Mixture | | |
| Water | 160.8 | 26.7 |
| POLYSTEP B-27 | 53.6 | 11.1 |
| Methacrylic acid (MAA) | 14.5 | 3 |
| Methyl methacrylate (MMA) | 260.6 | 54 |
| Butyl acrylate (BA) | 222 | 46 |
| Catalyst Solution | | |
| Water | 70 | 14.5 |
| Sodium persulfate | 2.5 | 0.52 |

In a three liter reaction vessel, equipped with a reflux condenser, addition funnels and stirrer, the Initial Charge of water was added to the reactor with agitation at 100 rpm. The reactor was heated to 78° C. and a 62 gram portion of the Monomer Mixture and 10 grams of the Catalyst Solution were charged to the reactor. After 20 minutes, the remainder of the Monomer Mixture was metered into the reactor over a period of 4 hours. The remainder of the Catalyst Solution was slow added to the reactor over a period of 4.5 hours. The reaction temperature was maintained for an additional 20 minutes, then 0.3 grams of tertiary butyl hydroperoxide in 5 grams of water and 0.3 grams of sodium formaldehyde sulfoxylate were added to the reactor. The polymerization was conducted at a pH of 4.5. The pH of the resulting latex was adjusted to between 7 and 8 by the addition of a 26.6% aqueous ammonium hydroxide solution.

Comparative Latex C1 was determined to have 0.003% coagulum, 49.0% solids, an average particle size of 91 nm, and a brookfield viscosity of 34 cps.

EXAMPLE 2

Preparation of Comparative Latex C2

A latex was prepared using the procedure and formula according to Example 1, except that 1.5 pphm of anionic surfactant sodium dodecyl benzene sulfonate (RHODACAL DS-10) and 3 pphm of nonionic surfactant nonylphenol ethoxylate with 40 moles of ethylene oxide (IGEPAL CA-897) were used instead of 3 pphm of anionic surfactant POLYSTEP B-27. As in Example 1, the pH of the latex was adjusted to 8 by the addition of a 26.6% ammonium hydroxide solution.

Comparative Latex C2 was determined to have 0.002% coagulum, an average particle size of 96 nm, a percent solids of 50.9, and a brookfield viscosity of 145 cps.

EXAMPLE 3

Preparation of Comparative Latex C3

Comparative Latex C3 was prepared using the procedure and formula according to Example 1, except that 1.5 pphm of methacrylic acid and 3 pphm of hydroxypropyl methacrylate were used instead of 3 pphm of methacrylic acid. As in Example 1, the pH of the latex was adjusted to 8 by the addition of a 26.6% ammonium hydroxide solution.

Comparative Latex C3 was determined to have 0.16% coagulum, an average particle size of 105 nm, percent solids of 50.6, and a brookfield viscosity of 150 cps.

EXAMPLE 4

Preparation of Comparative Latex C4

Comparative Latex C4 was prepared using the procedure and formula according to Example 1, except that 1.5 pphm of methacrylic acid and 4.8 pphm of N-methylol acrylamide were used instead of 3 pphm of methacrylic acid. The polymerization was conducted at pH of 4.5. As in Example 1, the pH of the latex was adjusted to 8 by the addition of a 26.6% ammonium hydroxide solution.

Comparative Latex C4 was determined to have 0.2% coagulum, an average particle size of 89 nm, percent solids of 48.1, and a brookfield viscosity of 90 cps.

EXAMPLE 5

Preparation of Comparative Latex C5

Comparative Latex C5 was prepared using the procedure and formula according to Example 1, except that 3.2 pphm of amphoteric surfactant Mirataine H2C-HA which is Sodium Laurimino Dipropionate and 2 pphm of methacrylic acid were used instead of 3 pphm of Polystep B-27 and 3 pphm of methacrylic acid. The polymerization was conducted at pH of 8.

Comparative Latex C5 was determined to have 0.001% coagulum, an average particle size of 85 nm, percent solids of 47.3, and a brookfield viscosity of 112 cps.

EXAMPLE 6

Preparation of Latex A1

A latex was prepared using the procedure and formula according to Example 1, except that 1.5 pphm of a polymerizable surfactant having terminal amine moieties (POLYSTEP AU-7 which is allyl amine salt of laureth ether sulfate) was used instead of 3 pphm of anionic surfactant POLYSTEP B-27. The polymerization was conducted at a pH of 3. As in Example 1, the pH of the latex was adjusted to 8 by the addition of a 26.6% ammonium hydroxide solution.

Latex A1 was determined to have 0.004% coagulum, an average particle size of 91 nm, a percent solids of 47.7, and a brookfield viscosity of 198 cps.

EXAMPLE 7

Preparation of Latex A2

A latex was prepared using the procedure and formula according to Example 1, except that 1.0 pphm of a polymerizable surfactant having terminal amine moieties (POLYSTEP AU-9 which is allyl amine salt of nonyl phenol ethoxylate, 9 moles EO, phosphate ester) was used instead of 3 pphm of anionic surfactant POLYSTEP B-27. The polymerization was conducted at a pH of 4.5. As in Example 1, the pH of the latex was adjusted to 8 by the addition of a 26.6% ammonium hydroxide solution.

Latex A2 was determined to have 0.005% coagulum, an average particle size of 123 nm, a percent solids of 48.7, and a brookfield viscosity of 90 cps.

EXAMPLE 8

Preparation of Latex A3

A latex was prepared using the procedure and formula according to Example 1, except that 1.5 pphm of a polymerizable surfactant having terminal amine moieties (POLYSTEP AU-1 which is allyl amine salt of dodecylbenzene sulfonate) was used instead of 3 pphm of anionic surfactant POLYSTEP B-27. The polymerization was conducted at a pH of 3.0. As in Example 1, the pH of the latex was adjusted to 8 by the addition of a 26.6% ammonium hydroxide solution.

Latex A3 was determined to have 0.01% coagulum, an average particle size of 95 nm, a percent solids of 47.6, and a brookfield viscosity of 135 cps.

EXAMPLE 9

Evaluation of Comparative Latex C1 and Latex A2 for Contact Angle

Latex C1 and A2 were measured for contact angle. The results are summarized in Table I.

TABLE I

| | Latex | |
|---|---|---|
| Contact angle measurements | C1 | A2 |
| Degrees at 0 minutes | 13 | 56 |
| Degrees at 5 minutes | 10 | 54 |
| Degrees at 7 minutes | 10 | 54 |
| Degrees at 10 minutes | 9 | 51 |

The test results in Table I show that Latex A2 had much higher contact angle than Comparative Latex C1 which is stabilized by a conventional anionic surfactant.

EXAMPLE 10

Comparative Latexes C1–C5, and Latexes A1–A3 which were prepared in Examples 1–8 were formulated with about 50 weight percent, based on the total weight of the latex, of a combination of melamine formaldehyde and urea formaldehyde resins. The formulated latexes were evaluated for water resistance and mechanical stability. The test results are summarized in Table II.

TABLE II

| Latex | C1 | C2 | C3 | C4 | C5 | A1 | A2 |
|---|---|---|---|---|---|---|---|
| Cobb test after 1 minute cured at 135° C. (gsm) | 44 | 72 | 38 | 72 | 27.5 | 24 | 21.0 |
| Cobb test after 10 minutes cured at 135° C. (gsm) | 27.5 | 37.5 | 19 | 55.5 | 20 | 16.5 | 15.0 |
| Mechanical stability Test (% Grits 200 Mesh) | pass (0.3) | pass (0.001) | pass (0.1) | pass (0.04) | poor (1) | pass (0.006) | pass (0.004) |

The test results in Table II show that the paper saturant compositions containing Latexes A1–A3 which were prepared with an aqueous emulsion polymer containing a polymerizable surfactant having terminal allyl amine moieties exhibited significantly greater water-resistance and mechanical stability as compared to Comparative Latexes C1–C5 which were prepared using conventional anionic and nonionic surfactants.

Paper saturated with the aqueous emulsion polymer of the invention is characterized by an excellent balance of toughness, water-resistance, wet strength, fold, edge tear, and delamination resistance, and is especially useful as core sheets used to prepare decorative laminates.

While the invention has been described with particular reference to certain embodiments thereof, it will be understood that changes and modifications may be made by those of ordinary skill within the scope and spirit of the following claims.

What is claimed is:

1. A paper saturant composition comprising an aqueous emulsion polymer, said polymer comprising the reaction product of at least one ethylenically unsaturated monomer and from about 0.1 to about 5 weight percent, based on the total weight of ethylenically unsaturated monomer, of a water-soluble or water-dispersible polymerizable surfactant having a terminal allyl amine moiety, wherein the polymerization is conducted at a pH of about 2 to about 7.

2. The composition according to claim 1 wherein the polymerizable surfactant is an allyl amine salt of alkyl benzene sulfonate having the structure

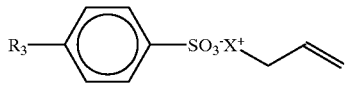

wherein $R_3$ is an alkyl group having 1 to 20 carbon atoms, and X+ is selected from the group consisting of $NH_3^+$, $NH_2R_6$ and $NR_6R_7$ wherein $R_6$ and $R_7$ are independently $C_1$–$C_4$ alkyl or hydroxyalkyl groups.

3. The composition according to claim 2 wherein the allyl amine salt of alkyl benzene sulfonate is allyl amine salt of dodecylbenzene sulfonate.

4. The composition according to claim 1 wherein the polymerizable surfactant having a terminal allyl amine moiety is present in an amount of from about 1 to about 3 weight percent based on the total weight of ethylenically unsaturated monomer.

5. The composition according to claim 1 wherein the ethylenically unsaturated monomer is selected from the group consisting of vinyl esters, α-olefins, anhydrides, alkyl esters of acrylic and methacrylic acid, substituted or unsubstituted mono and dialkyl esters of unsaturated dicarboxylic acids, vinyl aromatics, unsubstituted or substituted acrylamides, cyclic monomers, monomers containing alkoxylated side chains, sulfonated monomers, vinyl amide monomers, and combinations thereof.

6. The composition according to claim 1 wherein the ethylenically unsaturated monomer is selected from the group consisting of styrene, methyl methacrylate, butyl acrylate, and combinations thereof.

7. The composition according to claim 1 wherein the polymer further comprises an ionic monomer selected from the group consisting of α,β-ethylenically unsaturated $C_3$–$C_8$ monocarboxylic acids, α,β-ethylenically unsaturated $C_4$–$C_8$ dicarboxylic acids and the anhydrides thereof, $C_4$–$C_8$ alkyl half esters of the α,β-ethylenically unsaturated $C_4$–$C_8$ dicarboxylic acids, and combinations thereof.

8. The composition according to claim 7 wherein the ionic monomer is selected from the group consisting acrylic acid and methacrylic acid.

9. The composition according to claim 7 wherein the ionic monomer is present in an amount of from about 0.01 to about 10 weight percent, based on the total weight of ethylenically unsaturated monomer.

10. The composition according to claim 9 wherein the ionic monomer is present in an amount of from about 0.1 to about 5 weight percent, based on the total weight of ethylenically unsaturated monomer.

11. The composition according to claim 10 wherein the ionic monomer is present in an amount of from about 0.5 to about 3 weight percent, based on the total weight of ethylenically unsaturated monomer.

* * * * *